United States Patent [19]

Gullace

[11] Patent Number: 4,950,194

[45] Date of Patent: Aug. 21, 1990

[54] DOLL AND CASE HAVING FEATURES THAT SIMULATE SEED BEARING PLANTS

[76] Inventor: Marlene Gullace, 6317 Millwood Cir., Springfield, Va. 22152

[21] Appl. No.: 419,323

[22] Filed: Oct. 10, 1989

[51] Int. Cl.[5] ..... A63H 3/00; A63H 3/02; A63H 3/36; A01N 3/00

[52] U.S. Cl. ..... 446/72; 446/76; 446/369; 446/385; 428/17; D 21/155

[58] Field of Search ..... D 21/155, 185; D 20/41, D 20/29; 428/17, 18, 19, 21, 22, 23; 446/72, 71, 73, 74, 76, 268, 369, 372, 385, 387, 391, 394, 395

[56] References Cited

U.S. PATENT DOCUMENTS

| | | | |
|---|---|---|---|
| D. 62,294 | 5/1923 | Townsend | D21/155 |
| D. 146,132 | 12/1946 | Curran | D21/155 |
| D. 276,899 | 12/1984 | Deeley et al. | D21/155 X |
| D. 295,616 | 5/1988 | Smith | D21/155 X |
| 854,224 | 5/1907 | Lamprey | 428/22 X |
| 1,208,029 | 12/1916 | Smith | 446/385 |
| 2,478,480 | 8/1949 | Greer | 446/385 X |
| 3,471,964 | 10/1969 | Cherry et al. | 446/268 |
| 3,520,078 | 7/1970 | Klamer | 446/73 |
| 4,543,278 | 9/1985 | Ackerman | 428/18 |
| 4,737,129 | 4/1988 | Gorley et al. | 466/72 |

FOREIGN PATENT DOCUMENTS

| | | | |
|---|---|---|---|
| 240647 | 10/1925 | United Kingdom | 446/385 |

OTHER PUBLICATIONS

Appli-Press Fabric Applications, McCall's Novelty & Needlework Patterns, 1/1960, p. 165.

The Vegimals, Freemountain Toys, Inc., Playthings 7/78, p. 30.

*Primary Examiner*—Robert A. Hafer

*Assistant Examiner*—D. Neal Muir

*Attorney, Agent, or Firm*—Richard C. Litman

[57] ABSTRACT

A doll having body portion(s) indicative of the structural features of a dicotyledonous seed is disclosed. The doll has a head wherein the structural features of the head duplicates the structural features of a dicotyledonous seed. Moreover, the head contains indicia indicative of the coloring and coloring patterns of the seed emulated. Structural features of the seed such as the raphe, the strophiole, and the hilum are used to form various facial features such as the nose and mouth. Eyes are added to the structural features of the head to give the doll a lifelike appearance. Hair may be added to the head so that the doll incorporates the characteristics of age and gender. The doll includes a specific carrying-/display case having substantially the same markings and shape of the head of the doll. The case may be displayed on an advertising stand having the shape of a vine or other bean carrying stalk.

17 Claims, 2 Drawing Sheets

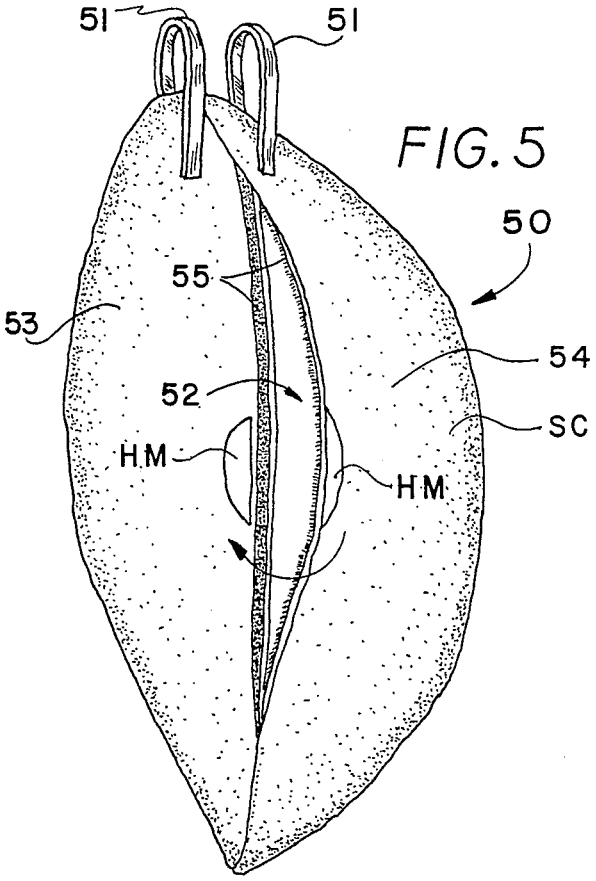
FIG. 5
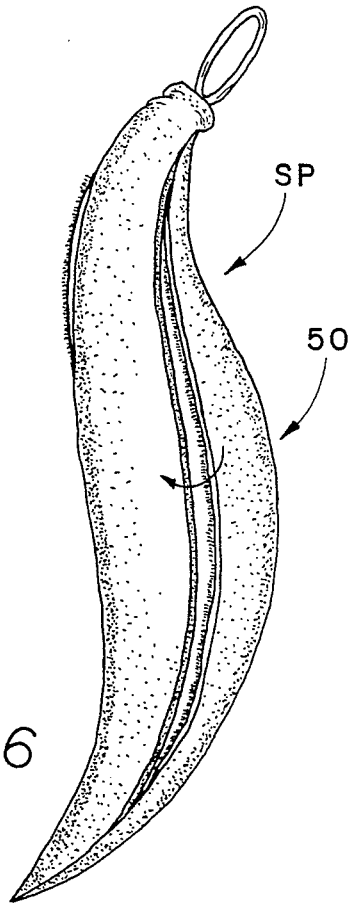
FIG. 6
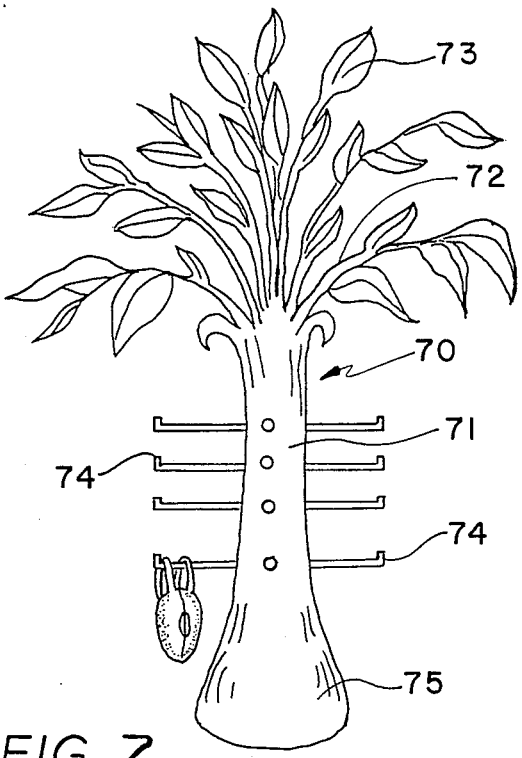
FIG. 7
FIG. 8
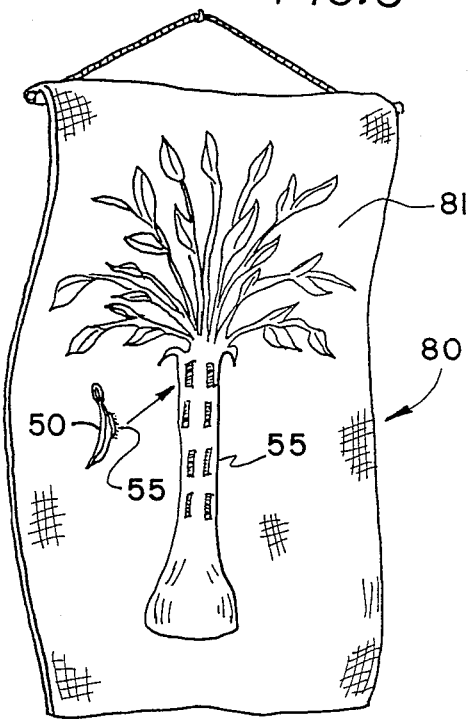

DOLL AND CASE HAVING FEATURES THAT SIMULATE SEED BEARING PLANTS

BACKGROUND OF THE INVENTION

1. Field of the Invention

The present invention relates to the construction of dolls. More specifically, the present invention relates to the construction of the physical features of dolls. The present invention incorporates structural features that emulate the physical appearance of a dicotyledonous seed. Moreover, the present invention incorporates a carrying and display case for a doll wherein the case is in the shape of a dicotyledonous seed coat or seed pod. The case and the doll itself are of the same specific variety and have the same color markings. The carrying/display case is designed so that it can hang from an advertising stand in the shape of a vine. Specifically, the advertising display takes the form of a vine or other bean producing flora. The seeds or beans are disposed thereon by a series of hook means.

2. Description of the Prior Art

The prior art discloses many types of dolls having a large variety of constructions. However, as vast as the prior art is, it does not disclose the specific structure of the dolls of the present invention. Moreover, the prior art does not disclose specific display means having a thematic relationship to the items displayed thereon. The dolls of the present invention may be encapsulated in a seed coat or seed pod shaped carrying and display case whereupon they may be displayed on the advertising stand.

Within the prior art, there are some dolls and display figurines which utilize the bean or seed as a body part of the invention. U.S. Pat. No. Des. 198,856 issued to A. R. Rossi on Aug. 11, 1964 is such an example. Rossi discloses a doll in the shape of a bipedal insect. Though not disclosed, it appears that the Rossi insect utilizes actual beans at least for the head and feet. The body may also be created from a bean.

U.S. Pat. No. Des. 205,713 issued to E. C. Wilson on Sept. 13, 1966 discloses a doll in the shape of a goat preparing to ram an unseen object. The body of the goat is comprised of a peanut shell. Legs, a tail, and a head have been added to define the shape of the goat's features.

Cursorily, these examples may seem to disclose some of the concepts of the present invention. However, this is not the case. The present invention actually uses the structural features of a bean to create the body features of the doll. No structure is deleted or wasted. The bean is simulated to the last detail in order to generate the doll of the present invention. The actual bean is not used.

Advertising displays have also been disclosed in the past having at least a plant like shape. U.S. Pat. No. Des. 250,615 issued to R. M. DeWeese on Dec. 19, 1978 discloses the shape of an advertising stand. The stand has the appearance of a potted plant having a single stalk. Three bulbous portions adorn the top portion of the stand. Apparently, these bulbous sections are representative of foliage or floral plumage.

U.S. Pat. No. Des. 291,545 issued to F. J. Falco on Aug. 25, 1987 discloses another advertising stand in the shape of a plant. In this example, the display incorporates a flower like structure at its top most portion. A plate is provided along the central shaft. Supposedly, this plate may be used to display pertinent information.

Branches including leaves are disposed thereon to give a botanical appearance.

These examples of plant like advertising displays are far afield the present invention. The present invention utilizes a stalk like advertising display means to display the dolls in their respective cases. As such, there is a direct thematic relationship between the advertising display and the item displayed thereon. Moreover, the home display of the present invention incorporates a unique method of attaching the dolls to the display surface. A Velcro TM surface on the case and dolls mates with the respective mating surface on the home display surface.

The case for the doll is not specifically addressed by the prior art. However, U.S. Pat. No. 1,536,125 issued to C. A. Moorman on May 5, 1925 discloses a display case having the anatomical features of livestock. The display case of the Moorman invention is designed for educational purposes. In this manner, the Moorman invention does relate to the present invention.

The present invention is designed both for education and enjoyment. The present invention is designed so that each of the individual dolls may duplicate almost exactly the complete structure of a dicotyledonous seed. As such, each doll may copy a different bean. Each bean will bear the color markings and the surface features of the naturally occurring seed. Each doll, therefore, is a means to teach about the particular bean. For example, were the doll to duplicate a coffee bean, the structure of the bean and its history could be disclosed in accompanying material.

Extending the present example, the bean's origin could be discussed. The manner in which the bean supplements the economy of the country in which the bean is grown could be explained. There are unlimited possible directions in which the present invention could be drawn. Regardless of all of them, the present invention is also designed to be a child's toy.

The total scope of the present invention will become more apparent as the present discussion unfolds.

SUMMARY OF THE INVENTION

Accordingly, it is an object of the present invention to provide a doll whose features duplicate the structural features of a dicotyledonous seed, part of the family Leguminosae.

It is another object of the present invention to utilize the surface feature of the dicotyledonous seed known as the hilum as a body feature of the doll.

It is still another object of the present invention to utilize the surface feature of the dicotyledonous seed known as the raphe as a body feature of the doll.

It is still another object of the present invention to utilize the surface feature of the dicotyledonous seed known as the micropyle as a body feature of the doll.

It is still another object of the present invention to utilize the surface feature of the dicotyledonous seed known as the strophiole as a body feature of the doll.

It is still another object of the present invention to utilize the surface feature of the dicotyledonous seed known as the seed coat as a body feature of the doll.

It is still another object of the present invention to utilize the surface feature of the dicotyledonous seed known as the colored markings as a body feature of the doll.

It is still another object of the present invention to utilize the shape of the dicotyledonous seed to define various body features of the doll.

It is yet another object of the present invention to provide an advertising display means in the shape of a vine for display of the bean shaped doll.

It is a further object of the present invention to provide a carrying case that duplicates the structural features of a dicotyledonous seed coat or seed pod.

It is another object of the present invention to provide a carrying case for the doll that duplicates the structural features of the bean type after which the doll is patterned.

It is still another object of the present invention to provide a means to hang the carrying case from the advertising display.

With these and other objects in view which will more readily appear as the nature of the invention is better understood, the invention resides in the novel combination and arrangement of parts hereinafter more fully described and illustrated, with reference being made to the accompanying drawings.

BRIEF DESCRIPTION OF THE DRAWINGS

FIG. 5 illustrates the carrying/display case of the doll shown in FIG. 1.

FIG. 6 illustrates the carrying/display case of the doll shown in FIG. 4 that utilizes the shape of the seed pod.

FIG. 7 is a side view illustration of the advertising display of the present invention.

FIG. 8 is a perspective illustration of the home display device of the present invention.

Similar reference characters designate corresponding parts throughout the various figures of the drawings.

DESCRIPTION OF THE PREFERRED EMBODIMENT

In order to fully comprehend the scope of the present invention, it is necessary to describe the structural features of a dicotyledonous seed. This discussion will utilize FIG. 1 for reference. The discussion falls under the heading of "Botanical Background". The invention will be discussed under the heading "Invention".

BOTANICAL BACKGROUND

Dicotyledonous seeds are included within the family Leguminosae. They are a sub category of the more general descriptive heading of seeds which are produced from two main categories of plant life, angiosperms and gymnosperms. Angiosperms are plant such as trees, shrubs, and soft stemmed plants which produce seeds from flowers. Gymnosperms comprise a much smaller category of plants. Gymnosperms, such as pine trees, produce cones instead of flowers.

Angiosperms comprise the vast majority of the more than 250,000 kinds of plants known. Gymnosperms comprise about 700 varieties of the 250,000 mentioned. Angiosperms produce seeds having either one or two cotyledons. Gymnosperms produce seeds having from two to eight cotyledons. Cotyledons are leaf like structures that absorb and digest nutrients from the food storage tissue of the seed. In angiosperms, the food storage tissue is called the endosperm. In gymnosperms, the food storage tissue is called the megagametophyte. In dicotyledonous seeds, the cotyledons themselves serve as the food storage tissue.

The present invention duplicates the structure of a dicotyledonous angiosperm seed. Therefore, this discussion will hereinafter be limited solely to the structure and function of the various parts of a dicotyledon. However, it should be noted at this point that there are seeds called monocotyledons which are differentiated from dicotyledons. Monocotyledons are seeds having only one cotyledon. These seeds also incorporate an endosperm. An example of a monocotyledon is the corn kernel.

Beans and pods such as the ones shown by the dolls in FIGS. 1–3 and 6 are dicotyledonous seeds. Usually, they are produced within a seed pod. The seed SD attaches to the interior of the seed pod via the funiculus. The scar that remains when the seed SD is removed from the funiculus is the hilum HM. The cotyledons CN of the seed are encapsulated by a protective seed coat SC. The funiculus supplies nutrients and water to the seed SD as it develops within the seed pod SP. The seed pod SP acts as a protective cover around the seed.

Figure 1:
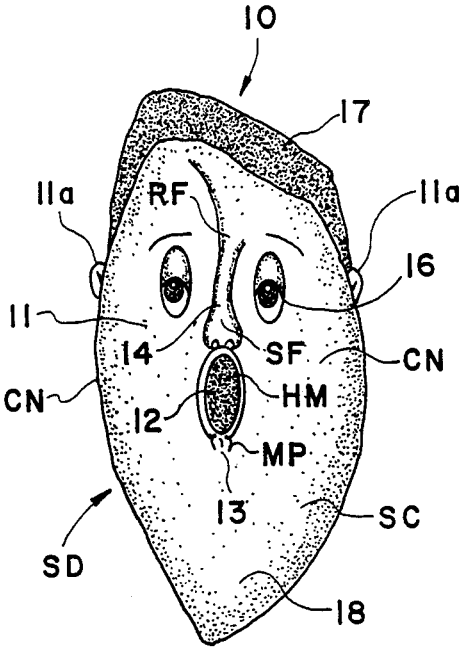
FIG. 1 is an illustration of the present invention showing the pertinent facial features of the doll.
Figure 2:
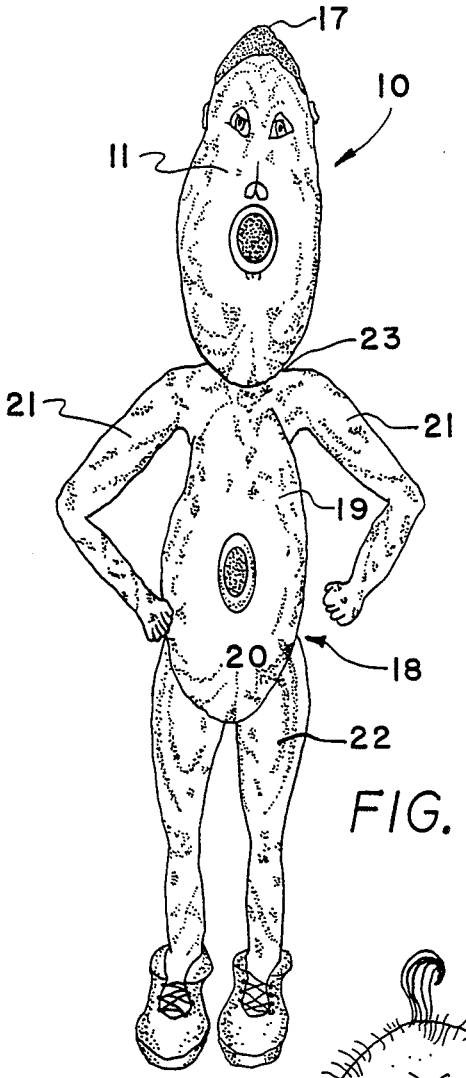
FIG. 2 is an illustration of an alternate embodiment of the present invention wherein separate beans of the same variety form the head and the torso of the doll.
Figure 3:
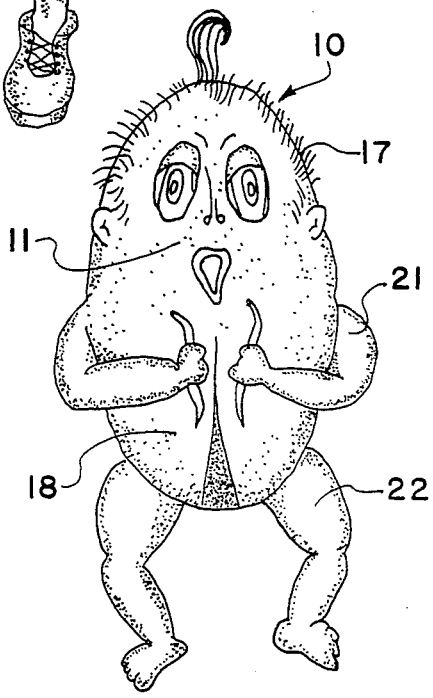
FIG. 3 is an illustration of still another example of the present invention wherein the bean shape provides the structure for both the head and the body together. Arms and legs are provided to define the structure of the doll. In this case, the doll takes the form of an infant.

FIGS. 1–3 dolls illustrate a bean shaped seed SD shown along the longitudinal axis. A small pore in the seed coat called the micropyle MP allows air to enter the seed SD. The micropyle MP is disposed at one of the longitudinal ends of the hilum HM. The seed SD may include a raphe RF and strophiole SF at the other end of the hilum HM. The raphe RF is the ridge extending longitudinally from the hilum HM. The strophiole SF is a bulbous structure at the end of the raphe RF disposed adjacent the hilum HM.

Beans have many uses and applications within today's society. Both the seed SD and the seed pod SP are usually edible and supply a wide variety of nutrients to humans and animals alike. Beans SD may also be used as fertilizer to enrich the nitrogen content of the soil. Due to their wide application, beans SD are a very important legume.

Perhaps the most widely used bean is the soy bean. The soy bean is composed of about 40% protein and 21% oil. As such, the soy bean seed is very valuable. It provides a protein rich food staple which is processed into various food products for human consumption. The oils can be used for cooking, as a lubricant, and even in ink for printing presses.

INVENTION

All of the structural features of the seed SD (bean) are essential to the construction of the present invention. The hilum HM, the raphe RF, the strophiole SF, the seed coat SC, seed pod SP and micropyle MP each serve a separate function in the present invention which is generally designated as 10 in FIGS. 1 and 4.

FIG. 1 is most illustrative of the present invention. FIG. 1 shows the construction of the face of a doll 10 of the present invention patterned after a Black bean. FIG.

1, FIG. 2, FIG. 3 and FIG. 5 are interrelated and will be discussed together.

The doll 10 has a face 11. The face 11 copies the structural features of the longitudinal axis of the bean SD having the hilum HM. The mouth 12 of the doll 10 is a duplication of the hilum HM of the seed SD. Below the mouth 12 is a dimple 13 in the chin. The dimple 13 is patterned after the location and structure of the micropyle MP. The tip of the nose 14 duplicates the structural features of the strophiole SF. The bridge of the nose 15 is patterned after the raphe RF.

Eyes 16 have been added to the face 11 to give the head of the doll 10 pleasing and attractive characteristics. Thus, the eyes 16 are one of the two features not present on the beans SD after which the doll 10 is patterned. Hair 17 has also been added to the face 11. The hair 17 is the second feature added to the doll 10 that may not be found on the seed coat SC on the seed SD. A third feature is the addition of ears 11*a* to the side of the face 11.

The body 18 of the doll 10 is made to match the same color markings and shape as the face 11 of the doll 10. As such, the marking of the brown pinto bean is duplicated on the body 18 of the doll 10 of the present example.

FIG. 2 shows the doll 10 with the body 18 attached. The torso 19 of the doll 10 is of particular importance. The torso 19 is designed such that it duplicates a majority of the structural features of the bean SD. In the present example, the hilum HM forms the bellybutton 20 of the doll_10. The micropyle MP is also utilized again as an extension of the bellybutton 20. The raphe RF and the strophiole SF are not duplicated on the torso 19 of the doll 10 as they have no corresponding component on the human body. However, this does not preclude their inclusion on the doll 10.

The body 18 of the doll 10 also includes the attachment of arms 21 and legs 22 thereto. The arms 22 are attached just below the neck 23 to simulate the placement of arms on human beings. The legs 22 are similarly situated. Overall, the shape of the doll takes the form of a bipedal humanoid.

However, the doll 10 need not have a body 18 as such. FIG. 3 shows the possible construction of a doll 10 in the form of an infant. In this example, the doll 10 has arms 21 and legs 22 attached directly to the bean structure which is defined as the face 11. The arms 21 and legs 22 are attached so that they simulate the appearance of an human infant. Hair 17 is sparingly attached to simulate the appearance of an infant. Thus, in this example, the face 11 and the body 18 are the same structural component. The arms 21 and legs 22 of the dolls 10 can be collapsable in that they fold inward. This would aid in the storage of the dolls 10 in their respective storage cases 50.

The carrying/display case 50 for the doll 10 is shown in FIG. 5. The carrying case 50 is designed so that it also duplicates the structural features of the seed coat SC of the bean SD. As such, the case 50 also duplicates the features of the face 11 save the features added such as the eyes 16 and the hair 17. The case 50 has an additional feature of handles 51 attached to the top most portion thereof. The handles 51 are inverted U-shaped loops attached to the case 50. The handles 51 allow a person to carry the case 50. The handles are also used to removably attache the case 50 to the display apparatus 70.

Figure 4:
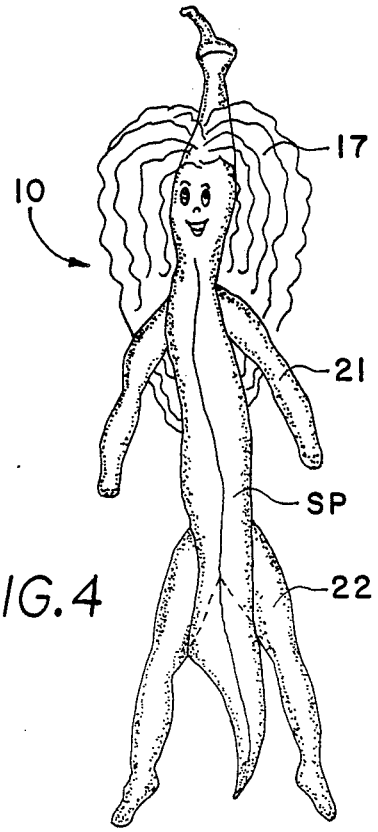
FIG. 4 is a front view of a doll made in accordance with the present invention where the seed pod of a dicotyledonous seed provides the shape for the doll.

An alternative doll form is Shown in FIG. 4 where the seed pod SP itself is used to provide both the head and torso of the doll 10. The arms 21, legs 22 and hair 17 can be attached as before to lend an anthropomorphic shape to the doll 10. The carrying case 50 shown in FIG. 6 for this seed pod shaped doll would also utilize the shape and coloration of the seed pod SP.

The hilum HM of the seed SD is used on the case 50 as well. However, the hilum HM is duplicated as a latch 52. The latch 52 is attached to the left side 53 of the case 50. The latch 52 attaches removably to the right side 54 of the case 50 to provide a securing means to lock the case 50 closed.

The latch 52 may be composed of a material having hook and loop fastening means 55 attached to one side. The hook and loop fastening means 55 is also known as Velcro TM . The hook portion of the hook and loop fastening means may be attached to the right side 54 of the case 50. As a result, the loop portion of the hook and loop fastening means 55 is attached to the latch 52 on the underside. Of course, the location of the hook or the loop portions of the hook and loop fastening means 55 may be juxtaposed, and the function of the latch 52 is not altered. Moreover, the latch may be attached to the right side 54 of the case 50 and engage the left side 53. Again, the function of the case 50 is not altered.

A zipper is another possible latch mechanism. Regardless of the type of latch 52, the function of the latch 52 is to provide a means to semipermanently close the case 50. Moreover, the latch 52 will appear as a duplication of the hilum HM whichever latch 52 and whatever material is used.

The advertising display stand 70 shown in FIG. 7 takes the physical appearance of a vine or other suitable bean bearing plant. The stand 70 is comprised of a central stalk 71. The stalk 71 contains branches 72 and leaves 73 to simulate a particular type of plant. Hooks 74 are provided about the periphery of the stalk 71 so that cases 50 containing the dolls 10 may be disposed thereon. The hooks 74 may also extend from the branches 72. A widened base portion 75 allows the display to stand upright on the floor.

An alternate embodiment of the advertising display 70 is the home display. The home display is a miniaturized version of the advertising display 70. The home display will also take the form of a bean bearing plant. Moreover, it may contain the hooks 74 that the advertising display 70 does. The home display is provided so that the individual has a place to display his or her dolls 10 at home.

An alternative of the home advertising display 80 is also offered. The alternative design is a sheet of material 81 that may be attached to a wall such as shown in FIG. 8. The material would need to be a material to which one half of hook and loop fastening means 55 may be attached. The material could be shaped and printed with indicia indicative of a vine or bean bearing plant. The handles 51 of the case 50 or the hilum HM may be provided with hook and loop fastening means 55 so that the case 50 may removably attach to the home display device 80.

It is to be understood that the present invention is not limited to the sole embodiment described above, but encompasses any and all embodiments within the scope of the following claims.

I claim:

1. A doll having a construction wherein a portion thereof duplicates the structural features of a dicotyledonous seed, comprising:

a head means including a top most portion and a bottom most portion, said head means substantially divided into two halves indicative of the two cotyledons of a dicotyledonous seed, said halves encapsulated by sheath indicative of the seed coat of a dicotyledonous seed, said sheath having colored indicia indicative of the coloring pattern of a specific dicotyledonous seed, said head means having an ellipsoid area disposed thereon indicative of the hilum of a dicotyledonous seed, said sheath having a pore disposed therethrough substantially near said ellipsoidal area indicative of the micropyle of a dicotyledonous seed, said head means having a ridge disposed along the edge where said halves are attached indicative of the raphe of a dicotyledonous seed, said ridge disposed substantially next to said ellipsoidal area indicative of the hilum of a dicotyledonous seed, said ridge indicative of the raphe having a bulbous portion indicative of the strophiole of a dicotyledonous seed disposed thereon at a bottom most portion of said ridge near said ellipsoidal area, eyes affixed to said head means above a line horizontally bisecting said ellipsoidal area, wherein said bulbous portion indicative of the strophiole of a dicotyledonous seed being the tip of the nose of said doll, wherein said ridge indicative of the raphe of a dicotyledonous seed being the bridge of the nose of said doll, and wherein the ellipsoidal area indicative of the hilum of a dicotyledonous seed being the mouth of said doll.

2. A doll having a construction wherein a portion thereof duplicates the structural features of a dicotyledonous seed according to claim 1, further comprising:

a body means attaching to said head means.

3. A doll having a construction wherein a portion thereof duplicates the structural features of a dicotyledonous seed according to claim 2, wherein said body means comprises:

a neck including a top most portion and a bottom most portion, said neck attaching to said head means at the top most portion of said neck, a torso attaching to the bottom most portion of said neck, said torso having two arms there attached, said torso having two legs thereattached, wherein said arms attaching a predetermined distance below said neck at a substantially equivalent horizontal position relative to said torso, wherein said legs attaching a predetermined distance below said arms at another substantially equivalent horizontal position relative to said torso, wherein said arms, said legs, said torso, and said neck substantially imitating structural arrangement found in a bipedal humanoid.

4. A doll having a construction wherein a portion thereof duplicates the structural features of a dicotyledonous seed according to claim 2, wherein said body means comprises:

a neck including a top most portion and a bottom most portion, said neck at said top most portion attaching to said head means, a torso attaching to said bottom most portion of said neck, said torso having two joined halves indicative of the two cotyledons of a dicotyledonous seed, said halves encapsulated by sheath indicative of the seed coat of a dicotyledonous seed, wherein said sheath on said torso means substantially duplicating the coloring indicia of said head means, said torso having an ellipsoid area disposed thereon indicative of the hilum of a dicotyledonous seed, said sheath having a pore disposed therethrough substantially near said ellipsoidal area indicative of the micropyle of a dicotyledonous seed, said torso means having a ridge disposed along an edge where said halves are attached indicative of the raphe of a dicotyledonous seed, said ridge disposed substantially next to said ellipsoidal area indicative of the hilum of a dicotyledonous seed, wherein said ellipsoidal area being indicative of a human navel, said torso having two arms there attached, said torso having two legs thereattached, wherein said arms attaching a predetermined distance below said neck at a substantially equivalent horizontal position relative to said torso, wherein said legs are attached a predetermined distance below said arms at another substantially equivalent horizontal position relative to said torso, wherein said arms, said legs, said torso, and said neck substantially imitating structural arrangement found in a bipedal humanoid.

5. A doll having a construction wherein a portion thereof duplicates the structural features of a dicotyledonous seed according to claim 1, wherein said head means further comprises:

hair attached to said top most portion of said head, and said hair affixed within pores disposed across the surface of said head.

6. A doll having a construction wherein a portion thereof duplicates the structural features of a dicotyledonous seed according to claim 1, wherein said doll further includes:

arms and legs directly affixed to said head means.

7. A doll having a construction wherein a portion thereof duplicates the structural features of a dicotyledonous seed according to claims 3 or 4, wherein:

said arms and legs are retractably collapsible.

8. In combination with a doll as in any one of claims 1–6, including:

a storage enclosure for said doll, said enclosure having an openable hollow shell structure that duplicates the structural features of a dicotyledonous seed.

9. The combination of a doll and enclosure as in claim 8, wherein:

said enclosure has handles attached to the external surface of said shell.

10. The combination of a doll and enclosure as in claim 8, wherein:

said enclosure includes attachment means for attaching said enclosure to a display assembly.

11. A doll having a construction wherein a portion thereof duplicates the structural features of the seed pod of a dicotyledonous seed comprising:

a body including a top most portion and a bottom most portion, said body having two halves, said halves representing two halves of a seed pod, a cylindrical member disposed at one end thereof, said cylindrical member duplicating a stem of a seed pod of a dicotyledonous seed, eyes disposed on said body substantially next to said cylindrical portion, a nose disposed below said eyes on said body, a mouth disposed below said nose on said body, arms disposed on said body below a horizontal line passing through said mouth, legs disposed on said body below said arms, and wherein positioning of said eyes, said nose, said mouth, said arms, and said legs simulates a bipedal humanoid.

12. A doll having a construction wherein a portion thereof duplicates the structural features of the seed pod of a dicotyledonous seed according to claim 11, wherein:

said legs being encapsulatable in said bottom most portion of said body, and said body at said bottom most portion folds to the posterior of said body and attaches to the back side thereof.

13. A doll having a construction wherein a portion thereof duplicates the structural features of a dicotyledonous seed pod according to claim 11, wherein said doll further includes:

hair attached to said body.

14. In combination with a doll as in any one of claim 11–13:

a storage enclosure for said doll, said enclosure having an openable hollow shell structure that duplicates the structural features of a dicotyledonous seed pod.

15. The combination of a doll and enclosure according to claim 14, wherein:

said enclosure has handles attached to the external surface of said shell.

16. The combination of a doll and enclosure according to claim 14, wherein:

said enclosure includes attachment means for attaching said enclosure to a display assembly.

17. A doll having a construction wherein a portion thereof duplicates the structural features of a dicotyledonous seed pod according to claim 11, wherein:

said arms and legs are retractably collapsible against said body.

* * * * *